United States Patent [19]

Goldblatt et al.

[11] 4,074,604

[45] Feb. 21, 1978

[54] SAW CHAIN COMPRISING CAM LINKS AND CUTTER LINKS WITHOUT INTEGRAL DEPTH GAUGES

[75] Inventors: Lawrence Goldblatt, Hamilton; Werner Weiss, Burlington; Peter A. MacIntyre, Waterdown, all of Canada

[73] Assignee: Textron, Inc., Providence, R.I.

[21] Appl. No.: 725,710

[22] Filed: Sept. 23, 1976

[51] Int. Cl.[2] ..... B27B 33/14
[52] U.S. Cl. ..... 83/830; 83/834
[58] Field of Search ..... 83/830, 833, 834

[56] References Cited

U.S. PATENT DOCUMENTS

| | | | |
|---|---|---|---|
| 2,905,209 | 9/1959 | Gudmundsen | 83/834 |
| 2,990,860 | 7/1961 | Ricci | 83/834 |
| 3,329,183 | 7/1967 | Robinson | 83/834 |
| 3,910,148 | 10/1975 | Weiss | 83/834 |

*Primary Examiner*—Donald R. Schran
*Attorney, Agent, or Firm*—Webb, Burden, Robinson & Webb

[57] ABSTRACT

A saw chain comprising a series of center links and pairs of side links pivotally joined to form a chain. Certain of the side links are cutter links formed without integral depth gauges. The chain further comprises special cam links bearing upstanding cam portions with upwardly and rearwardly inclined forward edges and rearwardly projecting tails. Each cutter link is preceded by a cam link disposed on the opposite side of the chain.

19 Claims, 3 Drawing Figures

$L_t$
$P_c$
$P_s$
D
D'
3
3

SAW CHAIN COMPRISING CAM LINKS AND CUTTER LINKS WITHOUT INTEGRAL DEPTH GAUGES

BACKGROUND OF THE INVENTION

This invention relates to the field of saw chain. The performance of a saw chain depends on various factors. Most important is cutting speed. A second very important factor in saw chain performance is the ability of the chain to retain a sharp cutting edge for a prolonged period, generally denominated the "stay sharp life" of the chain. Smoothness of operation constitutes a third crucial factor. Other factors include resistance to stretch, resistance to uneven or excessive bottom wear, and the avoidance of the dangerous kickback phenomenon.

The typical saw chain of the prior art more or less follows the configuration illustrated in Cox, U.S. Pat. No. 2,508,784 which comprises an alternating series of center links and pairs of side links pivotally joined to form a chain with certain of the side links being cutter links comprising an integral, upstanding cutter tooth formed at the rear of the link and an integral, upstanding depth gauge at the front of the link. Prior to the present invention, this general configuration was widely held in the art to give the best overall saw chain performance. The ability of a chain to make ripping cuts as well as cross cuts is also an important factor in saw chain performance. There is a continuing need to provide saw chains which give improved performance as to all of the foregoing aspects of chain quality.

OBJECT OF THE INVENTION

Accordingly, it is an object of the present invention to provide a saw chain for chain saws which has a higher cutting speed than conventional chains.

Another object of the invention is to provide a saw chain which has a greater stay sharp life than conventional chains.

A third object of the invention is to provide a saw chain which has a smooth cutting performance.

A fourth object of the invention is to provide a saw chain with increased resistance to stretch.

Another object of the invention is to provide a saw chain which does not exhibit uneven or excessive bottom wear.

Still another object of the invention is to provide a saw chain which substantially avoids the dangerous kickback phenomenon.

A further object of the invention is to provide a saw chain which can efficietly make rip cuts as well as cross cuts.

SUMMARY OF THE INVENTION

These and other objects of the invention are achieved by providing a saw chain comprising an alternating series of center links and pairs of side links pivotally joined to form a chain; certain of the pairs of side links being cutter pairs comprising a cutter side link on one side of the chain and a connecting side link on the other side of the chain; the cutter side links comprising a link body portion bearing an upstanding cutter tooth; each cutter link being formed without an integral depth gauge; the pair of side links next preceding each cutter pair being a cam pair comprising a connecting side link on the same side of the chain as the following cutter link and a cam link on the opposite side of the chain from the following cutter link; the cam link comprising a link body portion bearing an upstanding cam portion having an upwardly and rearwardly inclined forward edge and a rearwardly projecting tail; the maximum height of said center links and of said connecting side links being substantially less than the height of the cam portion of said cam link.

The objects of the invention are also achieved by providing a saw chain comprising an alternating series of center links and pairs of side links pivotally joined to form a chain; certain of the pairs of side links being cutter pairs comprising a cutter side link on one side of the chain and a connecting side link on the other side of the chain; each cutter link comprising a link body portion bearing an upstanding cutter tooth; the pair of side links next preceding each cutter pair being a cam pair comprising a connecting side link on the same side of the chain as the following cutter link and a cam link on the opposite side of the chain from the following cutter link; the cam link comprising a link body portion bearing an upstanding cam portion having an upwardly and rearwardly inclined forward edge and a rearwardly projecting tail; the cutter teeth on the cutter links and the cam portions of the cam links being the only parts of the chain adapted to engage material cut by the chain.

In its preferred form, each cutter tooth is integrally formed with the link body portion of a cutter link and comprises a shank portion extending upwardly from the upper edge of the link body and a toe portion extending laterally from the top of the shank portion, and the shank and toe portions have leading edges which are sharpened to form a continuous cutting edge.

Also in the preferred embodiment of the invention illustrated in the drawings, the pitch length of the side links is at least 10% greater than the pitch length of the center links; the tail of the cam portion of the cam link projects rearwardly of the axis about which the cam link pivots with respect to the following center link a distance greater than the pitch length of a center link but less than the pitch length of a side link, and the rearwardly projecting tail of the cam portion of the cam link is configured such that when the cam link pivots relative to the following links of the chain as the chain traverses the rounded end of a saw bar, the tail of the cam portion pivots outwardly and assumes a position further from the saw bar than the cutting edge of the following cutter link; the tail of the cam portion maintaining a constant effective depth gauge setting for the following cutter link whereby the cutter link is prevented from biting too deeply into the material being cut and kickback of the chain is prevented.

BRIEF DESCRIPTION OF THE DRAWINGS

The invention will be further explained with reference to the accompanying drawings wherein.

DESCRIPTION OF THE PREFERRED EMBODIMENT

Figures 1, 2, 3:
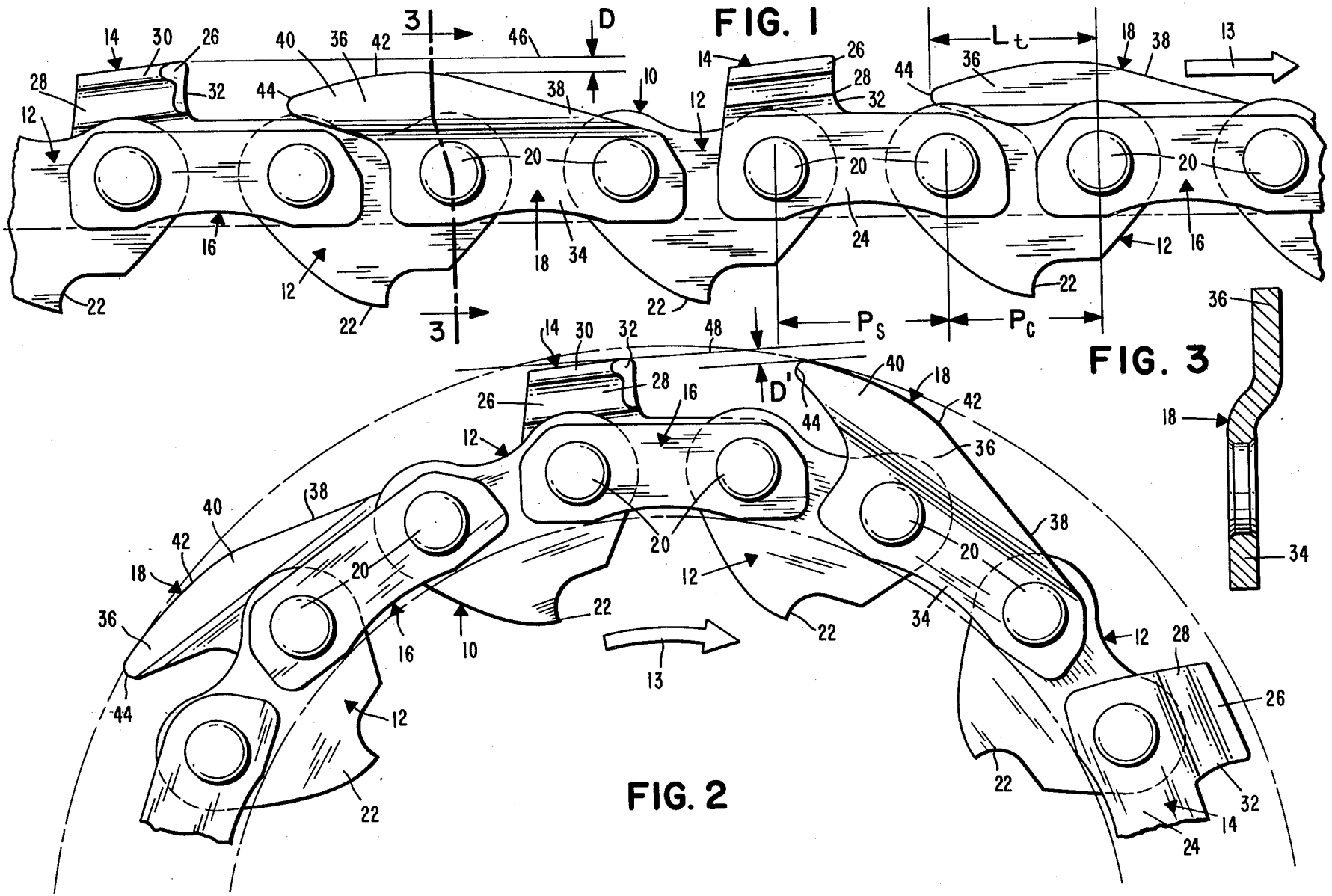
FIG. 1 is a side view of the saw chain of the present invention showing the relationship between the various links of the chain as the chain traverses the straight side of a saw bar.
FIG. 2 is a side elevation of the saw chain of the invention showing the relationship of the various links as the chain traverses the rounded nose of a saw bar.
FIG. 3 is a sectional view taken along line 3—3 of FIG. 1 illustrating the cross sectional configuration of the cam link in the saw chain of the invention.

The drawings show a saw chain generally designated by reference numeral 10 comprising an alternating series of center links 12 and pairs of side links. The side links are of three distinct types, cutter links 14, connecting links 16 and cam links 18. Each cutter link 14 is paired with a connecting link 16 to form a cutter pair. Likewise each cam link 18 is paired with a connecting link 16 to form a cam pair. The forward ends of each pair of side links are pivotally connected to the rear end of the preceding center link and the forward end of each center link is pivotally connected to the rear ends of the preceding pair of side links by means of rivets 20 to form a continuous chain in the well-known manner.

All references in this specification to the forward direction refer to the intended direction of chain travel as indicated in the drawings by arrows 13. References to the upward direction refer to the direction away from a saw bar upon which the chain is mounted, i.e. the direction in which the cutter teeth project away from the body portions of the cutter links. Reference to the rearward and downward directions refer, of course, to the directions opposite the forward and upward directions respectively.

Each center link is provided with a downwardly extending drive tang 22 adapted to travel in the groove of a conventional saw bar and to engage the teeth of a sprocket used to drive the chain. The lower margins of the various side links are adapted to ride on the rails of a conventional saw bar.

Each cutter link 14 comprises a link body portion 24 and an upstanding cutter tooth 26 integrally formed with the cutter link body portion. In the preferred embodiment, each cutter tooth 26 comprises a shank portion 28 extending upwardly from the upper edge of link body portion 24 and a toe portion 30 extending laterally from the upper end of shank portion 28. The leading edge of shank portion 28 and toe portion 30 is sharpened to form a continuous cutting edge 32.

In the illustrated preferred embodiment, successive cutter links along the length of the chain are allochiral, i.e. right hand and left hand mirror images of each other, and are disposed on opposite sides of the chain.

A distinctive feature of cutter links 14 of the saw chain of the present invention is the fact that they are formed without the usual integral depth gauges at the forward ends of the links. In other words, cutter tooth 26 is the only portion of the cutter link adapted to engage material being cut. This of course refers to the main body of material and not to individual shavings and chips severed by the cutters and carried along with the chain out of the cut. In other words, cutter tooth 26 is the only portion of cutter link 14 that engages the bottom of the kerf cut by the chain.

As previously mentioned, each cutter link 14 is paired with a connecting side link 16 on the opposite side of the chain to form a cutter pair. In the preferred embodiment illustrated in the drawings, each connecting side link 16 comprises a generally flat body. The shape of connecting side link 16 corresponds generally to the shape of body portion 24 of cutter link 14.

The pair of side links next preceding each cutter pair is a cam pair comprising a cam link 18 and a connecting side link 16. Each cam link 18 comprises a link body 34 bearing an upstanding cam portion 36. The shape of link body 34 corresponds generally to the shape of connecting side link 16. Cam portion 36 is provided with an upwardly and rearwardly inclined forward edge 38 and a rearwardly projecting tail 40 having a curved upper edge 42. The upwardly and rearwardly inclined forward edge 38 of cam portion 36 commences near the forward end of link 18, preferably forward of the axis of the rivet joining link 18 to the preceding center link 12 and extends smoothly upwardly and rearwardly to the highest point of cam portion 36 near the rear of link 18, preferably rearward of the axis of the rivet joining cam link 18 to the following center link. It is not essential that the forward edge of the cam portion be absolutely straight. Slightly convex or concave configurations are considered within the scope of the invention, as long as the overall inclination is in the upward and rearward direction. It is preferred that the forward edge of the cam portion make an angle between about 15° and about 20°, most preferably about 17°, with a line joining the centers of the front and rear rivets.

Tail 40 of cam portion 36 extends rearward of the rear margin of body portion 34 of cam link 18 into overlapping relation with the forward end of the following side link.

Cam link 18 is disposed on the opposite side of the chain from the following cutter link 14. In other words, each cam link is disposed directly ahead of the connecting side link which is paired with the followed cutter link. As previously noted, each cam link 18 is paired with a connecting side link 16 on the opposite side of the chain to form a cam pair. Each connecting side link 16 which is paired with a cam link 18 is disposed directly ahead of a cutter link 14. This arrangement of links has a significant effect on the cutting performance of the chain as will be seen from the tests described hereinafter.

The height of cam portion 36 of cam link 18 when the chain is straight is less than the height of cutter tooth 26 of cutter link 14. By height is meant the distance which a particular portion projects above the locus of points established by the centers of the rivets of the chain. This difference in height, represented by reference letter D, enables the cam portion 36 of cam link 18 to function as a depth gauge for the cutter 26 of the following cutter link 14. For effective cutting, the difference in height should be at least about 0.010 inch, preferably between about 0.015 and about 0.030 inch. In the preferred embodiment of a ⅜ pitch low profile chain illustrated in the drawings, the depth gauge setting or difference in height between the cam portion of the cam link and the cutter tooth of the following cutter link is about 0.020 inch.

In the chain of the invention, the height of centre links 12 and the height of the connecting side links 16 are each substantially less than the height of cam portion 36 of cam link 18. By substantially less in height is meant that there is a sufficient difference in height that the cutter teeth 26 of cutter links 14 and cam portions 36 of cam links 18 are the only parts of the chain which contact the material cut by the saw chain, i.e. the bottom of the kerf cut by the chain. Preferably the difference in height is greater than 0.030 inch. In the ⅜ pitch low profile chain illustrated in the drawings the difference in height is greater than 0.060 inch for the center links and 0.080 inch for the connecting side links.

The pitch of a link refers to the distance between the axis about which the link pivots with respect to the preceding link or links and the axis about which the link pivots with respect to the following link or links. Thus in the riveted chain illustrated in FIGS. 1 and 2, the pitch of a link is a distance between the centers of the rivet axes. In the chain illustrated in the drawings, the pitch of the side links $P_s$ is greater than the pitch of the center links $P_c$. Desirably the pitch of the side links is at least 10% greater than the pitch of the center links. Preferably the ratio of $P_s$ to $P_c$ is about 8 to 7. Thus, in a ⅜ pitch chain, $P_s$ would be about 0.390 inches and $P_c$ about 0.340 inches. The pitch of a chain is the average pitch of the individual links expressed in terms of a common fraction to the nearest 1/16 of an inch.

The length of tail 40 of cam portion 36 of cam link 18 is measured from the axis about which cam link 18 pivots with respect to the following center link 12 to the end 44 of the tail. Desirably, the length of the tail is at least approximately equal to the pitch length of the center link. Thus, in a ⅜ pitch semi-chisel chain, where the pitch length of the center link is approximately 0.341 inch, a tail length $L_t$ of 0.336 inch has been found satisfactory. In the preferred embodiment of the chain of the invention illustrated in the drawings, the length of the tail, $L_t$, is greater than the pitch length of the following center link $P_c$ and consequently, tail 40 extends rearward of the axis about which the following cutter link 14 pivots with respect to the intervening center link. Since the cam link is on the opposite side of the chain from the following cutter link, tail 40 of cam portion 36 of cam link 18 overlies a connecting side link 16. Where the pitch of the side links is greater than the pitch of the center links of a chain, it is preferred that $L_t$ be less than the pitch length of the side links $P_s$. Thus, in the ⅜ pitch low profile chain illustrated in the drawing, the length of the tail $L_t$ is about 0.370 inches or approximately equal to the pitch of the chain.

It is preferred that every second pair of side links be a cutter pair. This means, of course, that the remaining pairs of side links must be cam pairs and that there are no pairs of side links that do not contain either a cutter link or a cam link. In other words, every second pair of side links must also be a cam pair.

It has been determined that kickback results from the fact that the effective depth gauge setting of a conventional cutter increases markedly as the cutter traverses the rounded nose of a saw bar. When a cutter is traveling in a straight line along the straight edge of a saw bar as shown in FIG. 1, the angle of attack for the cutter is parallel to the direction of chain travel as indicated by reference line 46. However, as the cutter traverses the rounded nose of a saw bar, the angle of attack for the cutter increases as indicated in FIG. 2 by reference line 48, thereby increasing the effective depth gauge setting and allowing the cutter to bite too deeply into the wood. This has the effect of literally throwing the saw out of the kerf back toward the operator, the so-called kickback phenomenon.

In the chain of the present invention, the rearwardly projecting tail is configured so that it pivots outwardly as the cam link pivots with respect to the following center link when the chain traverses the rounded nose of a saw bar. The tail of the cam portion thereby assumes a position higher than the cutting edge of the following cutter, that is to say a position further from the locus of points established by the rivet axes. This prevents the following cutter from biting too deeply into the material being cut as the cutter traverses the nose of the saw bar thereby substantially eliminating the kickback phenomenon.

In the preferred embodiment, rearwardly projecting tail 40 of cam portion 36 is provided with a curved upper edge 42, and the curvature of edge 42 is selected to provide a substantially constant effective depth gauge setting, designated by reference letter D′, for the following cutter link as the chain traverses the nose of the saw bar.

FIG. 3 is a sectional view taken along line 3—3 of FIG. 1 illustrating the preferred configuration of cam link 18 in which cam portion 36 is laterally offset out of the plane of cam link body portion 34 away from the median plane of the chain. This configuration may be used to provide increased chip clearance and to adjust the balance of the forces acting on the chain during cutting in order to achieve smoother operation. However, successful chains can be produced using flat cam links in which the cam portion is aligned in the plane of the link body portion, and such chains are to be considered within the scope of the invention. The upper edge of cam portion 36 is blunt as the cam link is not intended to act as a cutting link, but instead is a non-cutting link.

The improved performance of the chain of the present invention will be understood from a consideration of the following tests:

Test I

A ⅜ pitch low profile saw chain without integral depth gauges on the cutter links and provided with cam links according to the invention was filed sharp and mounted on a Remington, 34 cc class chain saw having a 12 inch bar. Five cuts were made through a 10 inch by 10 inch oak log and an additional five cuts were made through a 10 inch by 10 inch pine log. The time required for each cut was noted, and the average cutting time and cutting speed were computed. The identical procedure was followed for a conventional ⅜ pitch low profile chain which had an integral depth gauge formed at the forward end of each cutter link and which did not have the cam links of the chain of the invention. The test results are shown in Table I:

Table I

| Chain Type | | Present Invention | Conventional |
|---|---|---|---|
| 10 × 10 | Red Oak | | |
| | Average Cutting Time | 43.02 sec. | 47.98 sec. |
| | Average Cutting Speed | 2.32 sq. in./sec. | 2.08 sq. in./sec. |
| 10 × 10 | Pine | | |
| | Average Cutting Time | 21.08 sec. | 25.47 sec. |
| | Average Cutting Speed | 4.74 sq. in./sec. | 3.93 sq. in./sec. |

It can be seen that the cutting speed of the present invention was 12% faster on the red oak and 21% faster on the pine than that of the conventional chain.

Test II

A ⅜ pitch low profile saw chain constructed according to the present invention was filed sharp and mounted on a Homelite, 57 cc class chain saw equipped with a 20 inch bar. The time required to make each of five cuts through a 12 inch by 12 inch hardwood log with the sharpened chain was noted, and the average cutting time and cutting speed were computed. Repeated cuts were then made through the hardwood log and a five cut average cutting time and cutting speed were re-computed. for the chain after cutting the amounts of wood indicated in Table II The chain is considered dull when the cutting speed decreases to 30% less than the filed sharp value.

Table II

| Amount of Wood Cut (sq. ft.) | 5 Cut Average Cutting Time (sec.) | 5 Cut Average Cutting Speed (sq. in./sec.) |
|---|---|---|
| filed sharp | 19.28 | 7.47 |
| 100 | 18.31 | 7.86 |
| 200 | 19.68 | 7.32 |
| 300 | 18.41 | 7.82 |
| 400 | 18.74 | 7.68 |
| 500 | 18.46 | 7.80 |
| 600 | 22.95 | 6.28 |

It can be seen that effective cutting was maintained for between 500 and 600 square feet of hardwood. Initial increases in the cutting speed are attributable to removal of the slight burr left on the cutting edge from the filing operation. The significance of this fact will be appreciated when it is understood that conventional ⅜ pitch low profile chain equipped with integral depth gauges and without the cam link of the chain of the present invention requires sharpening after cutting only 200 to 300 square feet. Moreover, stretch measurements taken of the test chain after cutting 500 square feet showed a stretch of only 0.00035 inch per rivet hole. Such stretch resistance is truly phenomenal when compared to the from 0.00038 to 0.00046 inch average stretch for conventional chain with integral depth gauges after only 250 square feet.

Examination of the test chain shows very even bottom wear of the side links. Moreover, the experienced saw chain operators who tested the chain of the invention indicated the chain had a very smooth cutting performance and virtually eliminated kickback. Actual tests also reveal that the saw chain of the invention performs astonishingly well in executing rip cuts as well as cross cuts.

Test III

The procedure of Test II was repeated with a ⅜ pitch semi chisel chain constructed according to the present invention. Test results are shown in Table III.

Table III

| Amount of Wood Cut (sq. ft.) | 5 Cut Average Cutting Time (sec.) | 5 Cut Average Cutting Speed (sq. in./sec.) |
|---|---|---|
| filed sharp | 23.25 | 6.19 |
| 200 | 19.38 | 7.73 |
| 300 | 18.79 | 7.66 |
| 400 | 19.27 | 7.47 |
| 500 | 19.86 | 7.25 |
| 600 | 17.70 | 8.13 |
| 700 | 19.05 | 7.56 |
| 800 | 23.19 | 6.21 |
| 900 | 28.64 | 5.03 |

It can be seen that the chain is still usefully sharp after cutting 900 square feet of wood. Stretch tests taken after 800 square feet of cutting showed a total stretch per rivet hole of 0.00051 inch. This is not much more than the stretch encountered in a conventional chain having an integral depth gauge after cutting only 250 square feet of hardwood. The usual stay sharp life of comparable prior art chains equipped with integral depth gauges is between 250 and 300 square feet.

Test IV

The procedure of Test II was repeated with an unchromed ⅜ pitch low profile chain. The results are tabulated in Table IV Table IV

| Amount of Wood Cut (sq. ft.) | 5 Cut Average Cutting Time (Sec.) | 5 Cut Average Cutting Speed (sq. in./sec.) |
|---|---|---|
| filed sharp | 16.85 | 8.55 |
| 50 | 17.55 | 8.30 |
| 100 | 17.06 | 8.44 |
| 150 | 16.95 | 8.50 |
| 200 | 18.44 | 7.81 |
| 250 | 23.36 | 6.16 |

It can be seen that over 200 square feet of hardwood were cut before the chain became dull. This is truly excellent performance for a chain with unchromed cutters. The usual stay sharp life for a chain with unchromed cutters is only 70 to 90 square feet.

Test V

The following test shows the significance of the configuration and location of the cam link of the chain of the present invention. Five experimental chains were made up differing only in the configuration or location of the cam link and the chains were tested by an experienced operator. Chain #1 was constructed according to the present invention. Chain #2 was the same as Chain #1 except the cam portion of the cam link was cut off even with the rear margin of the body portion of the cam link thereby eliminating the rearwardly projecting tail. Chain #3 was the same as Chain #1 except the cam link was disposed on the same side of the chain as the following cutter link. Chain #4 was the same as Chain #1 except a second cam link disposed on the same side of the chain as the following cutter link was paired with the cam link on the opposite side of the chain from the cutter. Chain #5 was the same as Chain #1 except that a cutter link was provided only on every third pair of side links and a pair of connecting links both corresponding to link 16 was interposed in the chain ahead of each pair. The operator comments regarding the test chains are tabulated in Table V.

Table V

| Chain | Operator Comments | Performance |
|---|---|---|
| Chain #1 | Cut rapidly and smoothly; | Performance excellent |
| Chain #2 | Extremely rough cutting; cutters dig into wood | Performance unsuitable |
| Chain #3 | Cuts very roughly and slowly; considerable kerf binding | Performance unsuitable |
| Chain #4 | Will not penetrate wood sufficiently for effective cutting | Performance unsuitable |
| Chain #5 | Rough and slow cutting | Performance unsuitable |

The tests show that the chain of the present invention exhibited a much smoother and more effective cutting performance than comparable chain having cam links differing either in location or in configuration.

The foregoing description has been set forth solely to exemplify the invention and not by way of limitation. Since modifications of the described embodiment which appropriate the spirit and substance of the present invention may occur to others skilled in the art, the scope of the invention is to be limited solely by the scope of the appended claims.

We claim:

1. A saw chain comprising an alternating series of center links and pairs of side links pivotally joined to form a chain;

certain of said pairs of side links being cutter pairs comprising a cutter side link on one side of the chain and a connecting side link on the other side of the chain;

said cutter link comprising a link body portion bearing an upstanding cutter tooth;

each said cutter link of said chain being formed without an integral depth gauge thereon;

the pair of side links next preceding each cutter pair being a cam pair comprising a connecting side link on the same side of the chain as the following cutter link and a cam link on the opposite side of the chain from the following cutter link;

said cam link comprising a link body portion bearing an upstanding cam portion having an upwardly and rearwardly inclined forward edge and a rearwardly projecting tail;

the maximum height of said center links and of said connecting side links being substantially less than the height of the cam portion of said cam link.

2. A saw chain as recited in claim 1 wherein each said cutter tooth is integrally formed with the link body portion of a cutter link and comprises a shank portion extending from the upper edge of said link body portion and a toe portion extending laterally from the top of said shank portion; said shank and toe portions having leading edges which are sharpened to form a continuous cutting edge.

3. A saw chain as recited in claim 1 wherein said cam link is a non-cutting link.

4. A saw chain as recited in claim 1 wherein the maximum height of the cam portion of each cam link when the chain is straight is from 0.015 inch to 0.030 inch less than the maximum height of the cutter tooth on the next following cutter link.

5. A saw chain as recited in claim 1 wherein the shape of the link body portions of the cutter links corresponds generally to the shape of the connecting links.

6. A saw chain as recited in claim 1 wherein the shape of the link body portions of the cam links corresponds generally to the shape of the connecting links.

7. A saw chain as recited in claim 1 wherein the inclined forward edge of the cam portion of the cam link leads smoothly from a point near the forward end of the cam link to the highest part of the cam portion.

8. A saw chain as recited in claim 1 wherein the tail of the cam portion of the cam link projects rearwardly of the axis about which the cam link pivots with respect to the following center link a distance not less than the pitch length of the center link.

9. A saw chain as recited in claim 1 wherein the pitch length of the side links is at least 10% greater than the pitch length of the center links.

10. A saw chain as recited in claim 9 wherein the tail of the cam portion of the cam link projects rearwardly of the axis about which the cam link pivots with respect to the following center link a distance greater than the pitch length of the center link but less than the pitch length of the side links.

11. A saw chain as recited in claim 1 wherein successive cutters along the length of the chain are allochiral and are disposed alternately along the length of the chain on opposite sides of the chain.

12. A saw chain as recited in claim 1 wherein the rearwardly projecting tail of the cam portion of a cam link is configured such that when the cam link pivots relative to the following links of the chain as the chain traverses the rounded end of a saw bar, the tail of the cam portion pivots upwardly and assumes a position further from the saw bar than the cutting edge of the cutter on the following cutter link whereby the cutter is prevented from biting too deeply into the material being cut and kickback of the chain is prevented.

13. A saw chain as recited in claim 12 wherein the upper edge of the tail of the cam portion of the cam link is curved in such a way that said tail maintains a constant effective depth gauge setting for the cutter of the following cutter link.

14. A saw chain comprising an alternating series of center links and pairs of side links pivotally joined to form a chain;

certain of said pairs of side links being cutter pairs comprising a cutter side link on one side of the chain and a connecting side link on the other side of the chain;

each cutter link consisting solely of a link body portion corresponding substantially in shape to the shape of the connecting side link with which the cutter link is paired and an upstanding cutter tooth integrally formed on said link body portion;

a pair of side links next preceding each cutter pair being a cam pair comprising a connecting side link on the same side of the chain as the following cutter link and a cam link on the opposite side of the chain from the following cutter link;

said cam link comprising a link body portion bearing an upstanding cam portion having an upwardly and rearwardly inclined forward edge and a rearwardly projecting tail;

the maximum height of said center links and of said connecting side links being substantially less than the height of the cam portion of said cam link.

15. A saw chain comprising an alternating series of center links and pairs of side links pivotally joined to form a chain;

certain of said pairs of said side links being cutter pairs comprising a cutter side link on one side of the chain and a connecting side link on the other side of the chain;

each said cutter link comprising a link body portion bearing an upstanding cutter tooth;

the pair of side links next preceding each cutter pair being a cam pair comprising a connecting side link on the same side of the chain as the following cutter link and a cam link on the opposite side of the chain from the following cutter link;

said cam link comprising a body portion bearing an upstanding cam portion having an upwardly and rearwardly inclined forward edge and a rearwardly projecting tail;

said cutter tooth being the sole portion of said cutter link adapted to engage material cut by the chain;

the maximum height of the cam portion of the cam link being less than the maximum height of the cutter tooth of the following cutter link;

the maximum height of said center links and said connecting side links being substantially less than the height of the cam portion of the cam link.

16. A saw chain comprising an alternating series of center links and pairs of side links pivotally joined to form a chain;

certain of said pairs of side links being cutter pairs comprising a cutter side link on one side of the chain and a connecting side link on the other side of the chain;

each side cutter link comprising a link body portion bearing an upstanding cutter tooth;

the pair of side links next preceding each cutter pair being a cam pair comprising a connecting side link on the same side of the chain as the following cutter link and a cam link on the opposite side of the chain from the following cutter link;

said cam link comprising a link body portion bearing an upstanding cam portion having an upwardly and rearwardly inclined forward edge and a rearwardly projecting tail;

the cutter teeth on the cutter links and the cam portions on the cam links of the chain being the only parts of the chain which engage material cut by the chain.

17. A saw chain as recited in claim 1 wherein said upwardly and rearwardly inclined forward edge makes an angle between about 15° and about 20° with a line joining the axes about which the cam link pivots with respect to the preceding and following center links.

18. A saw chain as recited in claim 1 wherein every second pair of side links is a cutter pair and the remaining pairs of side links are cam pairs.

19. A saw chain as recited in claim 1 wherein the cam portion of each cam link in laterally offset out of the plane of the cam link body portion away from the median plane of the chain.

* * * * *